United States Patent [19]

Bailey

[11] 4,322,015

[45] Mar. 30, 1982

[54] CONTAINER LID

[76] Inventor: John A. Bailey, 1679 Trapelo Rd., Waltham, Mass. 02154

[21] Appl. No.: 839,445

[22] Filed: Oct. 5, 1977

Related U.S. Application Data

[63] Continuation of Ser. No. 647,212, Jan. 7, 1976, abandoned, which is a continuation-in-part of Ser. No. 538,535, Jan. 6, 1975, abandoned.

[51] Int. Cl.[3] ..... B65D 41/46

[52] U.S. Cl. ..... 220/90.2; 220/266; 220/269; 220/270

[58] Field of Search ..... 220/90.2, 90.6, 266, 220/268, 269, 334, 335, 339, 355, 270

[56] References Cited

U.S. PATENT DOCUMENTS

| | | | |
|---|---|---|---|
| 3,385,501 | 5/1968 | Chang | 220/90.2 X |
| 3,442,416 | 5/1969 | Nicholson | 220/269 |
| 3,462,042 | 8/1969 | Stolle | 220/269 |
| 3,596,792 | 8/1971 | Wilcox | 220/270 |
| 3,800,999 | 4/1974 | Serritella | 220/266 X |

*Primary Examiner*—Steven M. Pollard

[57] ABSTRACT

There is disclosed a container lid having features which especially adapt it for use with beverage containers. The lid comprises a pair of tear impressions which define therebetween an access strip. After assembly of the lid to a container the access strip is pulled back from the rim of the lid along its tear impressions to create ready access to the contents. The access strip may be reclosed to the container to alleviate the problem of contents spillage during transport or motion of the container and further to preserve the thermal state of the contents.

10 Claims, 4 Drawing Figures

CONTAINER LID

This is a continuation of application Ser. No. 647,212, filed Jan. 7, 1976, abandoned, which application Ser. No. 647,212 is a continuation-in-part of application Ser. No. 538,535, filed Jan. 6, 1975, abandoned.

FIELD OF THE INVENTION

The present invention relates generally to container lids of the type presently conventionally employed as temporary closures in the food and beverage container industry.

Conventional beverage container or cup lids generally comprise a thin resilient polymeric material taking the form of a relatively flat central portion adapted to nest within and below the rim of the cup or container and rim-engaging means adapted to engage the container rim in a resiliently biased, manually releasable state. Drinking access to the contents of the container or cup to which such lids are attached is usually achievable only by way of complete removal of the lid. This, of course, exposes the container contents to the risk of spillage upon movement of the container. Thus, container lids of the prior art generally limit content access severely when the containers are employed in a moving vehicle, while walking or during any other activity which results in, or is likely to result in, jostling of the liquid contents. Further, complete lid removal to gain drinking access exposes a substantial surface of the contents to ambient temperature conditions and thus fosters relatively rapid and undesired temperature changes of the contents should their starting temperatures be hotter or colder than ambient.

In accordance with the present invention, these problems have been substantially alleviated.

It is, therefore, a principal object of the invention to provide a novel container lid.

It is another object of the invention to provide a container lid which allows direct access to container contents while being readily reclosed so as to substantially reduce temperature change and avoid spillage of the contents.

It is yet another object of the invention to provide a container lid which may be assembled to a container and, without total removal thereof, allow substantial access to the container contents.

It is another object of the invention to provide a container lid which may be assembled to a container and, without total removal thereof, allow substantial access to the container contents while further providing for reclosure.

It is another object of the invention to provide a container lid for beverage containers which allows direct access to container contents for drinking purposes while mitigating against spillage of said contents during transport or other movement of the container.

Other objects and advantages of the present invention will in part be obvious and will in part appear hereinafter.

SUMMARY OF THE INVENTION

The container lid of the invention comprises a relatively thin resilient polymeric sheet structure comprising a relatively flat central portion adapted to nest within and below the level of the rim of a container; rim-engaging means adapted to engage a container rim in a mutually releasable semi-locking relationship therewith; a pair of spaced apart tear impressions extending inwardly from the edge of the lid, which impressions terminate within said central portion and define therebetween a reclosable access strip; and tear stop means located at the inner end of each tear impression, said tear stop means defining therebetween a hinge area for said access strip. In a preferred embodiment of the invention the container lid additionally comprises retainer means adapted to engage and retain the reclosable access strip in its open position.

THE DRAWINGS

A better understanding of the invention may be had by reference to the drawings wherein.

Figure 3:
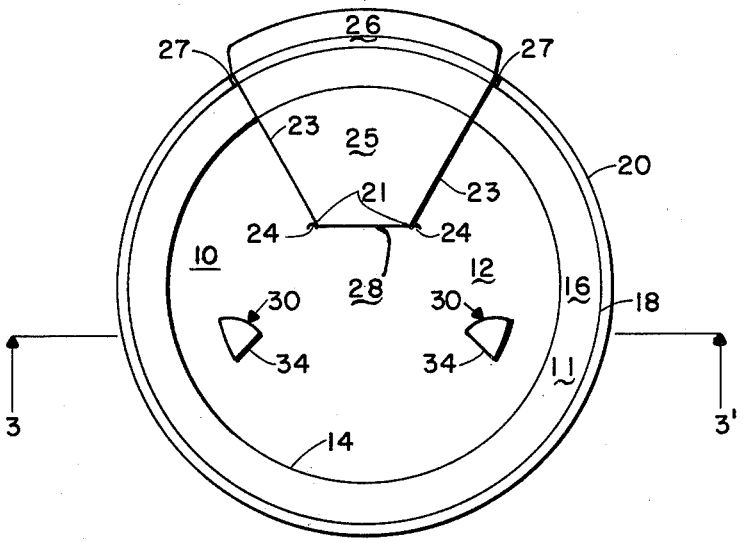
Figure 4:
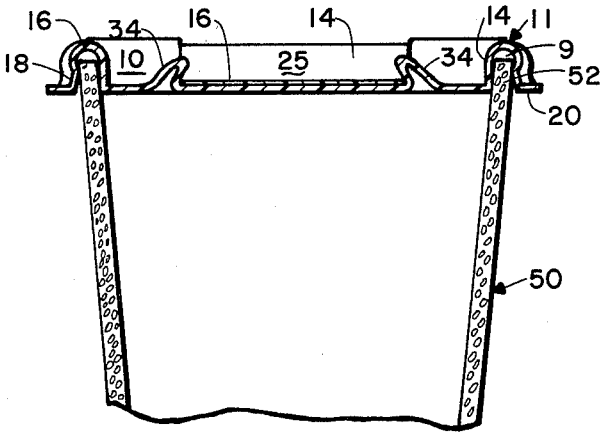

FIG. 3 is a schematic, diagrammatic top view of another embodiment of the container lid of the invention; and FIG. 4 is a schematic, diagrammatic, sectional side view of the container lid of FIG. 3 taken through line 3–3' thereof and showing the container lid attached to a suitable thermally insulative polymeric foam container and the reclosable access strip forming part of the lid in its open position.

DESCRIPTION OF PREFERRED EMBODIMENTS

Referring now to FIGS. 1 through 4, wherein like reference numerals refer to functionally similar structures, container lid 10 is formed of a thin sheet-form resilient polymeric material such as polystyrene, polyethylene, polypropylene, acrylonitrile-butadiene-styrene copolymer, polyvinylacetate, polyvinylbutyral, polyvinylchloride, cellulose acetate, cellulose acetate butyrate, cellulose nitrate and the like. Polystyrene has found favor in the fabrication of food and beverage container lids by reason of its good forming properties, relative inertness and economics. Accordingly, polystyrene and copolymers comprising at least 90 percent by weight of styrene monomer component represent preferred materials of construction for the container lids of the present invention.

Structurally, container lid 10 comprises a conventional relatively flat central portion 12 adapted to nest within and somewhat below the rim 52 of a container 50. The lid 10 also comprises a conventional rim-engaging means 11 to secure said lid 10 to container rim 52 in semi-locking, manually releasable arrangement therewith. Rim-engaging means 11 can comprise an inverted channel 9 defined by a generally ascending internal wall element 14 integral with and surrounding the entire perimeter of central portion 12; transverse arch element 16 integral with and extending outwardly from ascending wall element 14 and descending exterior wall element 18 integral with and descending from the exterior periphery of transverse arch element 16. Channel 9 is, of course, suitably sized and shaped so as to nest over container rim 52 in semi-locking, manually releasable association therewith. In order to promote facility in removing lid 10 completely from the container rim 52, the descending wall element 18 of rim-engaging means 11 is desirably projected outwardly at its lower extremity as shown as edge 20 thereof.

Figure 1:
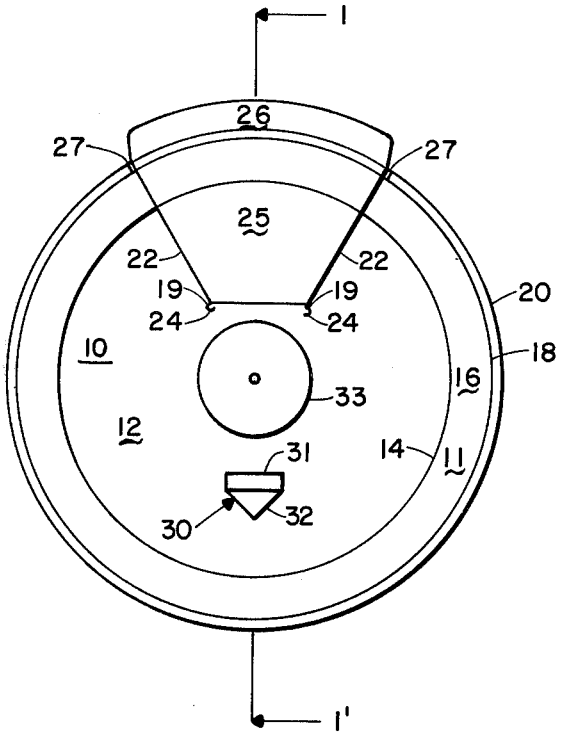
FIG. 1 is a schematic, diagrammatic top view of a container lid of the invention.
Figure 2:
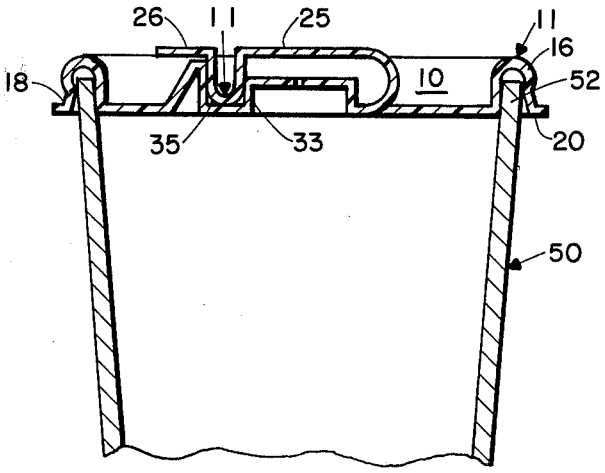
FIG. 2 is a schematic, diagrammatic, sectional side view of the container lid of FIG. 1 taken through line 1–1' thereof and showing the container lid attached to a suitable paper container and the access strip forming part of the lid in its open position.

In accordance with the invention, container lid 10 comprises a pair of spaced apart tear impressions 22 which extend inwardly from edge 20 and each of which impressions 22 terminate in tear stop means 24 located within central portion 12. It is the role of tear impressions 22 to foster failure of the polymeric material of construction along the predetermined lines defined thereby. Accordingly, said impressions 22 may each be molded, embossed or scored as a single continuous line into the surface of lid 10 (as shown in FIG. 1) or may each be performed as a plurality of spaced apart, relatively short impressions 23 (as shown in FIG. 3). The area defined between tear impressions 22 comprises the reclosable access strip 25. To facilitate handling access strip 25 is preferably provided with an extended edge section 26 substantially beyond edge 20 of the lid. To facilitate initiation of the tears along tear impressions 22 it is further preferred that the exterior ends of said impressions be faulted substantially completely through the polymeric material of construction. Said faults can conveniently take the form of slits or notches 27 which are located at edge 20 of lid 10.

The principal function of tear stop means 24 is to prevent tear propagation beyond the inner end of each tear impression 22. Bearing this function in mind, therefore, those skilled in the art will recognize that the tear stop means 24 can take various forms. For instance, in FIG. 1 the tear stop means 24 comprise small arcuate impressions 19 which are coextensive with the inner ends of tear impressions 22. In FIG. 3, the tear stop means 24 take the form of arcuate slits 21 located at the inner ends of impressions 22. Said arcuate slits 21 can also provide venting of the head space above the liquid contents of container 50 while preventing substantial loss of liquid therethrough. Faulting of the polymeric material other than the slits 21 specifically shown in FIG. 3 can also be found suitable, however, such as by cross or arcuate cuts at the inner ends of impressions 22. Other suitable tear stop means 24 can comprise localized thickenings or mechanical reinforcements of the polymeric lid material located at the inner ends of the tear impressions.

The general area defined between the tear stop means 24 constitutes a hinge area by which reclosable access strip 25 remains attached to central portion 12 of lid 10 upon rupture of the tear impressions 22 to their inner ends. If desired, though by no means necessary, one or more transverse impressions 28 or other line weakening such as shown in FIG. 3 may be provided between the tear stop means 24 so as to more clearly define the hinge point and to assure that a preponderance of the bending of the access strip 25 away from central portion 12 of lid 10 will occur at the intended hinge point.

In operations, the container lid 10 is affixed to rim 52 of container 50 in the conventional manner. Access to the container contents is gained by pulling extended edge section 26 upwardly and inwardly, thereby failing the pair of tear impressions 22 along their respective lengths and causing access strip 25 to fold back. Reclosure of the container lid is accomplished by reverse motion of the access strip 25 downwardly and outwardly and re-engagement of the portion of rim-engaging means 11 forming part thereof over the corresponding portion of rim 52 of container 50.

In a preferred embodiment of the invention, the container lid 10 will additionally comprise retainer means 30 to capture and maintain the access strip 25 in its open position. Many equivalents to the retainer means 30 specifically shown in FIGS. 1 through 4 will be apparent to those skilled in the art. For instance, the retainer means 30 can take the form of pressure sensitive adhesive dabs located on the upper surface of the central portion of the lid destined to contact the opened access strip and/or on the upper surface of the access strip. Likewise, the retainer means can comprise a separate and distinct mechanical structure attached to the lid. However, it is preferred that retainer means 30 be integral and formed along with the lid 10 structure. Accordingly, in the embodiment of FIGS. 1 and 2, retainer means 30 comprises the combination of molded-in vent cap 33 and a protrusion 32, each rising above the surface of central portion 12. The wall 31 of protrusion 32 facing access strip 25 is spaced from vent cap 33 so as to define a trough 35. In operations, access strip 25 is folded back and the rim-engaging means 11 thereof captured in the trough 35. By virtue of the resiliency of the thin polymeric material of construction of the lid 10, rim-engaging means 11 of access strip 25, wall 31 and vent cap 33 will be in biased condition in this arrangement and the forces of restitution will serve to maintain said rim-engaging means 11 in captured engagement, thereby to releaseably retain access strip 25 in its opened position. In the embodiment of FIGS. 3 and 4 retainer means 30 comprises two integrally formed spaced apart protrusions 34. The space between the protrusions 34 is such as to define and present a capture space to the rim-engaging means 11 of access strip 25. Operation of this embodiment of retainer means 30 also involves the folding back of access strip 25 and capture of the rim-engaging means 11 thereof by the protrusions 34. Releaseable maintenance of the captured state in this arrangement is also fostered by the resilient character of the thin sheet form polymeric material of construction.

A further benefit of the present invention appears to reside in a substantial reduction in the amount of litter attendant its use. It is apparently a psychological phenomenon that the lids of beverage containers are often discarded in an uncontrolled and careless manner whereas the beverage containers themselves tend to be disposed of in a significantly more circumspect and acceptable manner. Indeed, the problem of container lid litter is, at present, so acute that fast food chains and other food and beverage purveyors are loath to apply their names or otherwise identify themselves on the container lids employed for their food or beverage product containers. The container lids of the present invention, however, are not normally removed from the containers during use nor are the access strips forming part thereof separable therefrom. Accordingly, it is believed that the fundamental nature of the container lids of the invention tends to mitigate strongly against unrestricted disposal of parts thereof or disposal of the lids apart from their corresponding containers. Therefore, adoption of the container lids of the invention could conceivably and logically lead to substantial reductions in the nationwide problem of roadside litter.

Various vibration and motion tests have been conducted on the container lids of the invention with the access strips in both the open and reclosed positions. Negligible and acceptable amounts of spillage occurred under these tests, even under aggravated conditions. Various beverages, such as hot coffee and iced cold tonic, were tested with the lid either on or off. The thermal state of the container contents was maintained for a longer period with the container lids of the invention secured to the containers.

Although this invention has been described in the foregoing disclosure with a certain degree of particularity, it is to be understood that this disclosure is illustrative and nonlimiting in nature. Therefore, it is obvious that various changes, modifications and substitutions of equivalents in the details of construction and arrangements of parts explicitly described hereinbefore may be resorted to without departing from the spirit or scope of the invention as hereinafter claimed.

What is claimed is:

1. A container lid composed of a resilient thin polymeric sheet material and comprising:

a central portion adapted to nest within and below the rim of a container and rim-engaging means around the entire periphery of the lid, said rim-engaging means being adapted to secure said lid to the container rim in semi-locking, manually releasable relationship therewith;

a pair of spaced apart tear impressions extending inwardly from the edge of the container lid, each impression terminating at separate tear stop means therefor within said central portion thereof, said impressions and said tear stop means together defining a reclosable access strip having a self-forming hinge area affixing said access strip to said container lid; and retainer means comprising at least one protrusion molded into the surface of the central portion of the lid opposite said access strip, said retainer means being shaped and located to capture and releasably maintain said access strip in the open position.

2. The container lid of claim 1 wherein said reclosable access strip comprises an extended edge section projecting substantially beyond the exterior of that portion of the rim-engaging means associated with said access strip.

3. The container lid of claim 1 wherein the exterior end of each said tear impression is faulted through said polymeric sheet material.

4. The container lid of claim 1 wherein each said tear impression is a single continuous impression.

5. The container lid of claim 1 wherein each said tear impression comprises a plurality of spaced apart relatively short impressions.

6. The container lid of claim 1 wherein each said tear stop means comprises a small arcuate impression.

7. The container lid of claim 1 wherein each said tear stop means comprises a fault through the polymeric sheet material.

8. The container lid of claim 7 wherein each said tear stop means comprises an arcuate slit.

9. The container lid of claim 1 wherein said retainer means comprises a pair of spaced apart protrusions molded into the surface of the central portion of the lid opposite said access strip; said protrusions being spaced and shaped to capture and releasably maintain said access strip in the open position therebetween.

10. The container lid of claim 1 wherein said retainer means comprises the combination of a vent cap and at least one protrusion molded into the surface of the central portion of the lid, each said protrusion being spaced from said vent cap to define a trough therebetween, each said trough being located and being of a size and shape to capture and releasably maintain said access strip in the open position.

* * * * *